US005800636A

United States Patent [19]

Tsukada et al.

[11] Patent Number: 5,800,636

[45] Date of Patent: Sep. 1, 1998

[54] DUST CORE, IRON POWDER THEREFOR AND METHOD OF MAKING

[75] Inventors: Takeo Tsukada; Masaaki Kanasugi; Masataka Miyashita; Kazuhiro Okada; Norishige Yamaguchi, all of Chiba, Japan

[73] Assignee: TDK Corporation, Tokyo, Japan

[21] Appl. No.: 779,240

[22] Filed: Jan. 3, 1997

[30] Foreign Application Priority Data

Jan. 16, 1996 [JP] Japan ..... 8-023141
Aug. 29, 1996 [JP] Japan ..... 8-247076

[51] Int. Cl.[6] ..... H01F 1/22

[52] U.S. Cl. ..... 148/306; 75/232; 75/246; 252/62.55

[58] Field of Search ..... 148/104, 306; 75/246, 232; 252/62.55

[56] References Cited

U.S. PATENT DOCUMENTS

| | | | |
|---|---|---|---|
| 3,777,295 | 12/1973 | Laing . | |
| 4,158,581 | 6/1979 | Krause et al. . | |
| 4,158,582 | 6/1979 | Krause . | |
| 4,320,080 | 3/1982 | Esper et al. . | |
| 4,543,208 | 9/1985 | Horie et al. . | |
| 4,601,765 | 7/1986 | Soileau et al. . | |
| 4,620,933 | 11/1986 | Ochiai et al. . | |
| 4,696,725 | 9/1987 | Ochiai et al. . | |
| 4,820,338 | 4/1989 | Ochiai et al. . | |
| 4,919,734 | 4/1990 | Ochiai et al. . | |
| 4,927,473 | 5/1990 | Ochiai et al. . | |
| 5,466,276 | 11/1995 | Sato et al. | 75/231 |
| 5,507,853 | 4/1996 | Ogura et al. | 75/252 |
| 5,651,841 | 7/1997 | Moro et al. | 148/309 |
| 5,702,630 | 12/1997 | Sasaki et al. | 252/62.55 |

FOREIGN PATENT DOCUMENTS

| | | |
|---|---|---|
| 51-20594 | 2/1976 | Japan . |
| 55-130103 | 10/1980 | Japan . |
| 62-72102 | 4/1987 | Japan . |
| 1-298101 | 12/1989 | Japan . |
| 4-219902 | 8/1992 | Japan . |
| 7-166201 | 6/1995 | Japan . |
| 7-107883 | 11/1995 | Japan . |
| 8-45724 | 2/1996 | Japan . |

OTHER PUBLICATIONS

The Chemical Society of Japan, No. 10, pp. 1785–1790, 1987, Kumi Ochiai, et al.,"An Ancapsulation Process by Sol–Gel Method For Magnetic Metal Powder".

*Primary Examiner*—John Sheehan
*Attorney, Agent, or Firm*—Oblon, Spivak, McClelland, Maier & Neustadt, P.C.

[57] ABSTRACT

A dust core is prepared from an iron powder with a particle size of 75–200 μm having added thereto 0.015–0.15 wt % of silica sol, 0.05–0.5 wt % of a silicone resin, and 10–50 wt % based on the silicone resin of an organic titanium compound. By subjecting the iron powder to a curing treatment at 50°–250° C., compacting the powder, and annealing in an inert atmosphere at 550°–650° C., there is obtained a dust core consisting essentially of iron powder particles with a particle size of 75–200 μm, 0.03–0.1% by weight of Si, 15–210 ppm of Ti, and 300–2,500 ppm of oxygen.

9 Claims, 3 Drawing Sheets

DUST CORE, IRON POWDER THEREFOR AND METHOD OF MAKING

BACKGROUND OF THE INVENTION

1. Field of the Invention

This invention relates to a dust core for use as magnetic cores in transformers and inductors, cores in motors, and other electromagnetic parts, an iron powder for forming the dust core, and a method for preparing the dust core.

2. Prior Art

In the prior art, silicon steel lamination cores having punched silicon steel sheets stacked are often used in inductance elements of electronic devices. The lamination cores, however, are difficult to automate a manufacturing process. Especially when cores for motors and other drive equipment are prepared by punching from sheets, the material yield is extremely low because such cores have a complex shape. To fabricate three-dimensional shapes, a great number of working steps is necessary.

There are known dust cores or powdered-iron cores wherein soft magnetic metal powder is bound with a binder such as water glass. Iron powder, permalloy powder and sendust powder are typical of the soft magnetic metal powder. Dust cores can be integrally formed and worked even if they are of complex shape. The material yield is substantially 100%. The dust cores are expected to become a substitute for the lamination cores.

Among the soft magnetic metal powders, alloy powders such as permalloy powder and sendust powder, however, cannot be a substitute for the silicon steel lamination core commonly used in drive equipment because these powders have a low magnetic flux density despite low coercivity.

With respect to iron powder, there are commercially available different forms of iron powder prepared by various processes such as electrolytic decomposition and water atomization processes. They have a coercivity of more than 2 Oe which is not so low as comparable to silicon steel. Gas atomized iron powder has a coercivity of about 1 Oe, but is extremely expensive and thus inadequate as a substitute for the silicon steel lamination core.

The soft magnetic alloy powders naturally have a high hardness because they are alloys. When the powder is compressed into a compact, the rate of compression is too low. It is then believed that such powder cannot achieve a high magnetic flux density comparable to that of silicon steel. With respect to the iron powder, if the particle size is of the order of 150 μm, its coercivity can be reduced to a level close to the coercivity (about 0.40 Oe) of pure iron sheeting described in Magnetic Material Handbook, Asakura Shoten. It is then believed that iron powder has a possibility of satisfying both the requirements of low coercivity and high magnetic flux density.

A number of proposals have been made for improving the characteristics of dust cores.

For example, Japanese Patent Application Kokai (JP-A) 72102/1987 discloses an iron powder for dust cores having an oxygen content of 0.15 to 0.5% by weight, a mean particle size of 40 to 170 μm and an average aspect ratio of 4/1 to 25/1. Oxide coatings on iron particles provide for insulation between particles to reduce eddy current losses. The oxygen content is relatively high because the target is a high frequency band of higher than about 1 MHz. Dust cores prepared using an epoxy resin binder suffer from increased hysteresis losses because annealing treatment at high temperature for reducing coercivity must be precluded.

JP-A 222207/1986 discloses a method for preparing a dust core by contacting magnetic metal powder with silica sol or alumina sol, followed by drying and molding. It is described that since drying causes the silica sol or alumina sol to gel to form a three-dimensional network structure, the insulation between magnetic metal particles is not adversely affected by heat treatment at high temperature. However, since the silica sol or alumina sol as dried has no positive bonding effect, only a little shape retaining ability is left after heat treatment, resulting in low strength. Since the heat treatment temperature is limited to 500° C. or lower, no sufficient annealing effect is achieved.

JP-A 219902/1992 discloses a dust core composition comprising ferromagnetic powder which can be annealed at a temperature of up to 600° C. and 3.9% by weight of $SiO_2$ as a binder, the composition being consolidated and molded. The silicon dioxide is derived by hydrolysis of ethyl silicate. However, a coating resulting from hydrolysis of ethyl silicate does not achieve sufficient binding action, failing to produce dust cores having high mechanical strength.

Therefore, it is desired to have a dust core featuring a high magnetic flux density, low coercivity and low loss, especially at a frequency in the range of 50 to 10,000 Hz and capable of substituting for the conventional silicon steel lamination core with respect to electrical and physical characteristics.

SUMMARY OF THE INVENTION

In a first aspect, the present invention provides an iron powder composition for dust cores comprising iron powder consisting of particles with a particle size of 75 to 200 μm, 0.015 to 0.15% by weight as solids based on the iron powder of silica sol, 0.05 to 0.5% by weight based on the iron powder of a silicone resin, and 10 to 50% by weight based on the silicone resin of an organic titanium compound.

The iron powder composition may further comprise up to 20% by weight of a dispersant based on the weight of the silicone resin and the organic titanium compound combined. The dispersant is preferably ethyl cellulose. Preferably the iron powder has been subject to oxidation treatment.

In a second aspect, the present invention provides a dust core consisting essentially of iron powder particles with a particle size of 75 to 200 μm, 0.03 to 0.1% by weight of silicon, 15 to 210 ppm of titanium, and 300 to 2,500 ppm of oxygen.

In a third aspect, the present invention provides a method for preparing a dust core comprising the steps of:

(1) furnishing a core-forming iron powder composition as defined in the first aspect, (2) subjecting the core-forming iron powder composition to a curing treatment at 50° to 250° C., (3) compacting the powder composition into a compact, and (4) annealing the compact in an inert atmosphere at 550° to 650° C.

The thus prepared dust core is as defined in the second aspect.

Preferably step (1) of furnishing a core-forming iron powder composition includes the steps of:

subjecting a powder mixture of a starting iron powder, a heat resisting powder, and 0.5 to 5% by weight of the starting iron powder of an alkaline earth metal carbonate powder to heat treatment for annealing, typically in a hydrogen/nitrogen mixed atmosphere or a pure nitrogen atmosphere and at a temperature of 1,200° to 1,400°C., whereby the alkaline earth metal carbonate is decomposed into an alkaline earth metal oxide;

optionally disintegrating the heat treated powder mixture in a non-oxidizing atmosphere;

separating the heat resisting powder and the alkaline earth metal oxide powder from the powder mixture to leave an annealed iron powder;

optionally subjecting the annealed iron powder to oxidation treatment prior to the addition step: and adding silica sol, a silicone resin and an organic titanium compound, and optionally a dispersant to the annealed iron powder.

ADVANTAGES

The above-mentioned and other problems are solved according to the present invention by moderately oxidizing high purity iron powder and adding a minor amount of a unique insulating binder, thereby minimizing a percentage of a non-magnetic portion to prevent any loss of magnetic properties and maintaining sufficient insulation between iron particles as well as sufficient core strength. As a consequence, the dust core performs well in a frequency band of 50 to 10,000 Hz, especially 50 to 1,000 Hz, and can substitute for the conventional silicon steel lamination core.

The present invention uses a mixture of silica sol, a silicone resin and an organic titanium compound as an insulating binder. Silica sol is well insulating, but less binding. Then the mechanical strength of dust cores cannot be increased by the sole use of silica sol. The silicone resin cures with the heat applied during annealing treatment and thus functions as an insulating binder for dust cores, offsetting the drawback of silica sol. However, since the silicone resin is too soft before annealing treatment, a green insulating coating of silica sol and silicone resin is readily broken during compaction and is less effective for helping the compacted powder retain its shape. Additionally, the silicone resin is so adhesive that iron particles are likely to agglomerate, aggravating compaction of iron powder. If the silicone resin is completely cured prior to compaction, then the agglomeration of iron powder before compaction and the breakage of the insulating coating during compaction can be avoided, but the binding action of the silicone resin is lost so that the compact cannot fully retain its shape.

Then the present invention adds to the silicone resin an organic titanium compound which serves as a crosslinking agent for the silicone resin and prior to compaction, carries out curing treatment at a relatively low temperature to effect crosslinking reaction of the silicone resin to a certain extent. This partial curing not only avoids the agglomeration of iron powder before compaction and the breakage of the insulating coating during compaction, but also improves the shape retention of the compact. Compaction is followed by annealing treatment which permits the silicone resin to completely cure in the presence of the organic titanium compound as the crosslinking agent. Then the annealing treatment results in a dust core having an extremely high mechanical strength.

Both silica sol and silicone resin are so heat resistant that even after high temperature annealing treatment to cause the iron powder to release stresses for reducing coercivity, sufficient insulation is maintained between iron particles to prevent the eddy current loss from increasing.

The dust core of the invention is highly reliable in that its core loss increases little even after it is used over a long period of time under severe conditions, for example, in an environment having a high temperature, high humidity and substantial temperature variation.

BRIEF DESCRIPTION OF THE DRAWINGS

These and further features of the present invention will be apparent with reference to the following description and drawings, wherein.

DESCRIPTION OF THE PREFERRED EMBODIMENTS

Figure 1:
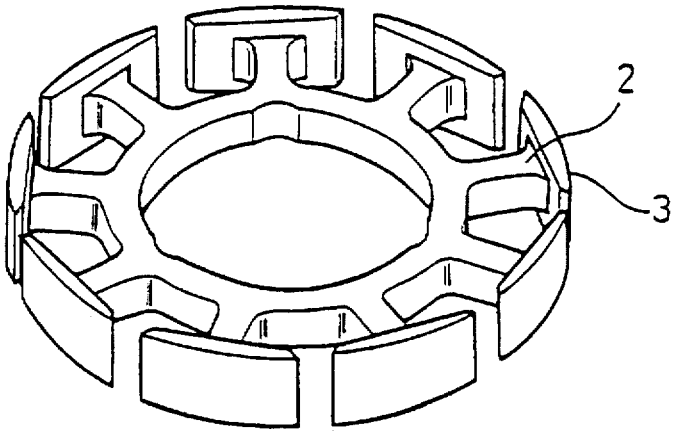
FIG. 1 is a schematic perspective view of an exemplary motor stator core.

According to the invention, an iron powder composition for use in the preparation of dust cores is obtained by adding to iron powder a binder containing silica sol, a silicone resin and an organic titanium compound.

The silica sol used herein is a colloid silica in which negative charged amorphous silica particles are dispersed in water or an organic dispersing medium. Silica particles have —SiOH groups on their surface.

The amount of silica sol added to the iron powder which is calculated as solids, that is, the amount of silica particles added is 0.015 to 0.15% by weight, preferably 0.03 to 0.1% by weight based on the weight of the iron powder. For example, a silica sol containing about 30% by weight of silica particles is added to iron powder in an amount of about 0.05 to 0.5% by weight, preferably 0.1 to 0.3% by weight. If the amount of silica sol solids added is too small, then the final dust core would suffer from poor insulation between iron particles. If the amount of silica sol solids added is too large, then the final dust core would contain more of a non-magnetic portion such as $SiO_2$ and have a low magnetic flux density.

The silicone resin used herein is an organopolysiloxane having an organosiloxane bond, more specifically an organopolysiloxane having a three-dimensional network structure (to be referred to as a specific silicone resin, hereinafter). Although the silicone resin used herein is not critical, it is essential to use the specific silicone resin. The specific silicone resin may be used alone or in admixture with any of ordinary silicone resins such as silicone oil and silicone rubber. Such a mixture of silicone resins should preferably contain at least 50% by weight of the specific silicone resin based on the entire silicone resins. Use of the specific silicone resin alone is recommended. The silicone resin is generally based on dimethylpolysiloxane although it is acceptable that some of the methyl groups are replaced by other alkyl or aryl groups.

In mixing the silicone resin with iron powder, the silicone resin may take the form of a solution prior to mixing if it is solid or liquid or be directly mixed with iron powder if it is liquid. When the solution of silicone resin is used, the solvent must be removed by drying prior to compaction. It is then preferred to directly mix the liquid silicone resin with iron powder without converting into a solution. The liquid silicone resin should preferably have a viscosity of about 10 to 10,000 centipoise at 25° C., more preferably about 1,000 to 9,000 centipoise at 25° C. With a viscosity outside this range, it would be difficult to form a uniform coating of silicone resin around iron particles.

The amount of the silicone resin added to the iron powder is 0.05 to 0.5% by weight, preferably 0.1 to 0.3% by weight based on the weight of the iron powder. A less amount of the silicone resin would result in a dust core having poor mechanical strength and insufficient insulation between iron particles whereas too much silicone resin would result in a dust core having a higher percentage of a non-magnetic portion and hence, a low magnetic flux density.

The organic titanium compound serves as a crosslinking agent for the silicone resin. The organic titanium compound used herein is at least one member selected from titanium alkoxides and titanium chelates. The titanium alkoxide may be a monomer, oligomer or polymer alone or in admixture of two or more. Preferred examples include tetraalkoxytitaniums whose alkyl group has 1 to 8 carbon atoms, such as tetra-i-propoxytitanium, tetra-n-butoxytitanium, and tetrakis (2-ethylhexoxy)titanium. Among these, tetra-i-propoxytitanium and tetra-n-butoxytitanium are more preferred, with tetra-n-butoxytitanium being most preferred. Especially preferred are oligomers and polymers of tetra-n-butoxytitanium represented by the following formula.

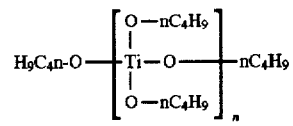

(I)

In formula (I), n is an integer of up to 10, preferably n=2, 4, 7 or 10, more preferably n=4. There is a tendency that the rate of crosslinking reaction decreases as the value of n increases.

Preferred examples of the titanium chelate include di-n-propoxy-bis(acetylacetonato)titanium and di-n-butoxy-bis (triethanolaminato)titanium.

It is preferred to use the alkoxides among the above-mentioned organic titanium compounds. The alkoxides have many advantages that they are liquid at room temperature, they can be readily mixed with liquid silicone resins, they have an appropriate rate of hydrolysis, and they are easily available.

The amount of the organic titanium compound added is 10 to 50% by weight, preferably 20 to 35% by weight based on the weight of the silicone resin. A less amount of the organic titanium compound would fail to help the silicone resin undergo sufficient crosslinking reaction so that the insulating coating might be broken upon compaction, resulting in cores having increased eddy current losses and insufficient mechanical strength. An excessive amount of the organic titanium compound would contribute to no substantial improvement in mechanical strength and result in cores having low magnetic permeability and increased eddy current losses.

The binder may further contain a dispersant. When iron powder is subject to oxidation treatment, to be described later, to form an oxide coating around iron particles for the purpose of enhancing the insulation between iron particles, the oxidation treatment exacerbates the wetting of the surface of iron particles with the silicone resin and silica sol. The dispersant is effective for improving this wetting. Improved wetting forms a more uniform insulating coating, enabling to reduce the eddy current loss. It is understood that owing to addition of the dispersant, some dust cores can be less reliable during storage at high temperatures as will be demonstrated later in Example.

The amount of the dispersant added is preferably up to 20% by weight, more preferably up to 15% by weight based on the weight of the silicone resin and the organic titanium compound combined. Too much amounts of the dispersant would lead to increased eddy current losses partially because electric resistance is reduced by carbonization of the dispersant. To fully improve the wetting of the surface of iron particles which can be exacerbated by the oxidation treatment, the dispersant is preferably added in an amount of at least 5% by weight, more preferably at least 8% by weight based on the weight of the silicone resin and the organic titanium compound combined. The dispersant may be ethyl cellulose, methyl cellulose, etc., with ethyl cellulose being preferred. It is noted that conventional silicon coupling agents are unsuccessful in improving the wetting of the iron particle surface.

Figure 4:
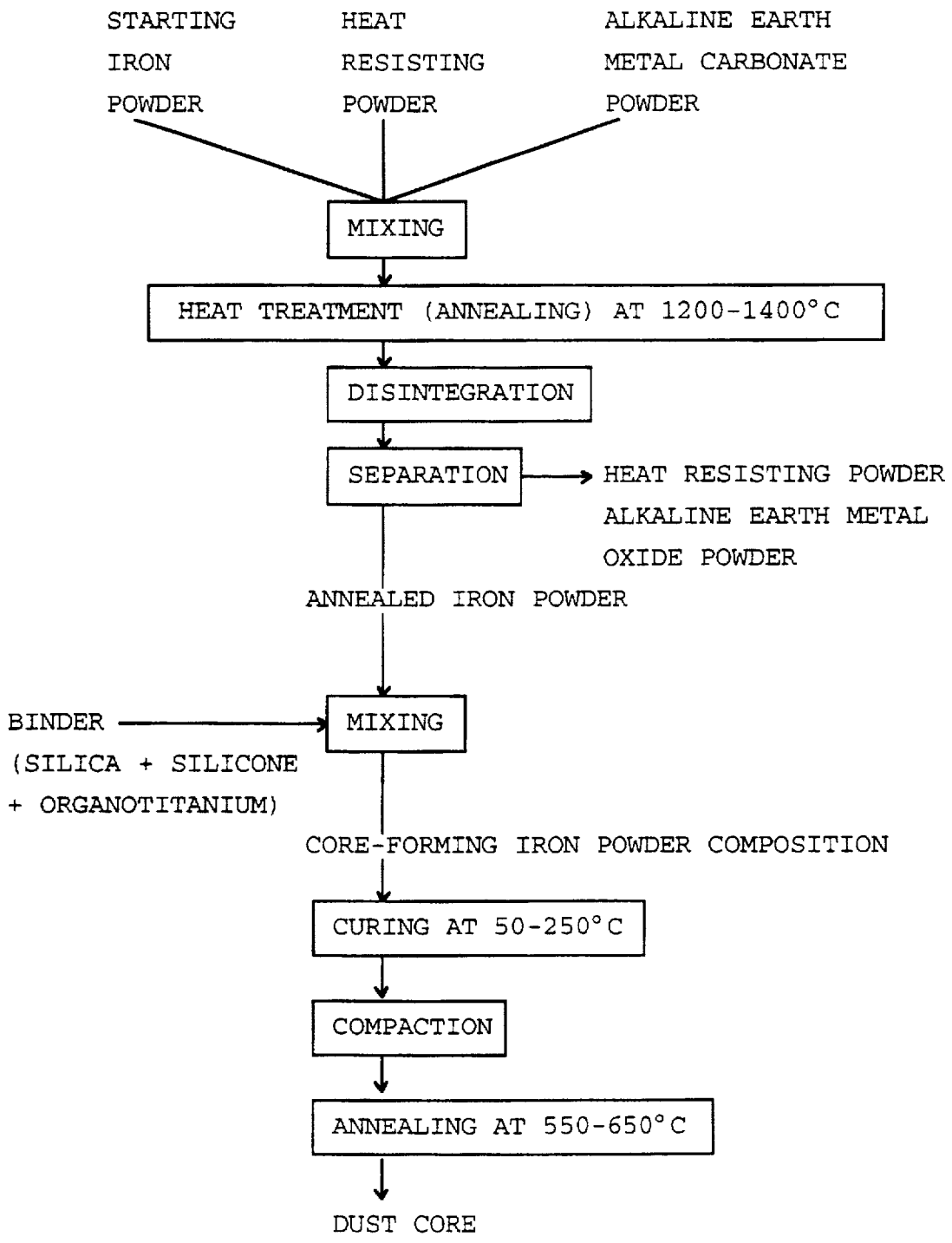
FIG. 4 is a flow chart illustrating steps of a process for preparing a dust core from a starting iron powder.

Referring to FIG. 4, the flow chart illustrates steps of a process for preparing a dust core from a starting iron powder.

Until now, the present invention intends to provide a dust core which substitutes for conventional silicon steel lamination cores for operation in a relatively low frequency range. In this regard, iron powder having high purity and high saturation magnetization is used as a starting material. Such iron powder may be prepared by any of conventional processes including atomization, electrolytic process, and electrolytic process followed by mechanical pulverization. Purity of iron is preferably at least 2N (99% by weight), more preferably from 2N to 4N (99.99% by weight).

Preferably the iron powder consists of particles having a particle size of 75 to 200 μm, more preferably 125 to 180 μm. A too small particle size would lead to greater coercivity whereas a too large particle size would lead to greater eddy current losses. An iron powder with a particle size in the above-defined range may be obtained by classification using a mesh screen.

In the practice of the invention, the starting iron powder is preferably subject to heat treatment for annealing prior to mixing with the binder. In order that heat treatment at high temperature be effective for fully reducing the coercivity of iron powder while avoiding sintering of iron powder, it is preferred to mix iron powder with a heat resisting powder which does not react with iron powder at high temperatures and an alkaline earth metal carbonate powder and heat treat the mixture. This step is described below in detail.

The heat resisting powder includes powdery oxides, carbides, and nitrides having a melting point higher than the temperature of heat treatment. A choice is preferably made of ceramic powders such as aluminum oxide, calcium oxide, and zirconium carbide. Aluminum oxide is especially preferred because it is commercially available as abrasive. Additionally, aluminum oxide abrasives are available as commercial products having various mean particle sizes and a narrow particle size distribution.

No particular limit is imposed on the mean particle size of the heat resisting powder. The heat resisting powder is separated from the iron powder after heat treatment. If this separation is done by a magnetic process, then the mean particle size of the heat resisting powder may be equal to that of the iron powder. If the separation is done by means of a mesh screen, then a heat resisting powder having a particle size range not overlapping the particle size distribution of iron powder may be selected, for example, a heat resisting powder having a mean particle size of 5 to 50 μm being usually preferred. If the mean particle size of heat resisting powder is too large, then a more amount of heat resisting powder is required to fully prevent iron powder from being sintered, which eventually requires a greater quantity of energy for heating, and the overlap of particle size distribution between heat resisting powder and iron powder disturbs complete separation and removal of the heat resisting powder. If the mean particle size of heat resisting powder is too small, then heat resisting powder particles having penetrated into recesses in the surface of soft magnetic iron particles are difficult to separate. Additionally, the increased surface area of heat resisting powder increases the reactivity of heat resisting powder itself to invite partial sintering, failing to achieve the desired anti-sintering effect.

The amount of heat resisting powder mixed is not critical since it varies depending on the type and mean particle size of heat resisting powder, the temperature of heat treatment, the preparation method and shape and size of iron powder particles. In general, at least an equal amount, preferably a 1.1 to 1.5 times greater amount of heat resisting powder is mixed with iron powder, as measured in apparent volume. If a too much amount of heat resisting powder is used, the powder mixture would have an increased thermal capacity and heat transfer resistance, requiring a longer time for heating and cooling of heat treatment. For a heating furnace of the same volume, the excess of heat resisting powder means that the amount of loadable iron powder is reduced, leading to an increased process cost.

Another component to be mixed with iron oxide is alkaline earth metal carbonate powder. It is known to mix a heat resisting powder with iron powder for preventing sintering before heat treatment for annealing is carried out, but not known to mix an alkaline earth metal carbonate. Although the action and mechanism of alkaline earth metal carbonate are not well understood, it is presumed that the alkaline earth metal carbonate decomposes to give off carbon dioxide gas in the heating step of heat treatment, this gas fills in voids in the powder mixture to prevent sintering between particles and at the same time, a portion of the gas diffuses into the iron particles as carbon to contribute to enlargement of crystal grain size. The carbon dioxide gas evolved also prevents formation of a firm bond between soft magnetic particles and other particles, facilitating subsequent separation and removal of redundant particles.

The alkaline earth metal carbonate used herein is preferably at least one of magnesium carbonate, calcium carbonate, strontium carbonate and barium carbonate, with the calcium carbonate, strontium carbonate and barium carbonate being preferred. Carbonates of metals other than alkaline earth metals are not useful because such carbonates melt to promote sintering during the heating step to the temperature of heat treatment and they are so hygroscopic that they are only available in the form of salt hydrates. Similarly magnesium carbonate tends to form a salt hydrate.

Like the heat resisting powder, the mean particle size of the alkaline earth metal carbonate powder may be properly selected depending on various conditions including a separation process after the heat treatment. If separation after the heat treatment is done by means of a mesh screen, then the alkaline earth metal carbonate powder preferably has a mean particle size of 5 to 50 μm like the heat resisting powder.

The amount of the alkaline earth metal carbonate powder added is 0.5 to 5% by weight, preferably 1 to 3% by weight of the starting iron powder. A less amount of the carbonate powder would be ineffective for reducing coercivity and preventing sintering. A larger amount of the carbonate powder would supply an amount of carbon to promote sintering so that more coarse particles are created as a result of sintering and provide a bar against effective removal of the heat resisting powder, resulting in compacts having low saturation magnetization.

A mixture of the starting iron powder, the heat resisting powder and the alkaline earth metal carbonate powder is subject to heat treatment for the purposes of removing residual stresses from the iron powder which have been introduced due to working strains and thermal hysteresis during the preparation process, removing oxygen and increasing the size of crystal grains.

Heat treatment may be carried out in a hydrogen/nitrogen mixed atmosphere or an inert atmosphere of pure nitrogen. Even when such inexpensive, easy to handle gases are used, an improvement in magnetic properties is accomplished to at least an equal extent as in a pure hydrogen atmosphere. In the case of hydrogen/nitrogen mixed atmosphere, the proportion of hydrogen is preferably up to 30% by volume because hydrogen is expensive and cumbersome to handle. Although argon and other rare gases may also be used as the inert atmosphere, they are more expensive than hydrogen and impractical.

The temperature of heat treatment preferably ranges from 1200° C. to 1400° C. Lower temperatures would be sufficient to remove strains and stresses, but insufficient for crystal grains to grow, failing to provide a fully low coercivity. Higher temperatures are acceptable if below the melting point (about 1560° C.) of iron, but impractical because a greater amount of heat resisting powder must be added in order to prevent sintering. During the heat treatment, the alkaline earth metal carbonate is decomposed into an alkaline earth metal oxide.

After the heat treatment, the heat resisting powder and alkaline earth metal oxide powder are separated and removed from the powder mixture, yielding an annealed iron powder. Where a non-magnetic powder as typified by aluminum oxide is used as the heat resisting powder, the separating means may be a magnetic separator. Where a choice is made of the heat resisting powder and alkaline earth metal oxide powder having a particle size distribution which does not overlap the particle size distribution of iron powder, a simple mesh screen may be used for separation and removal.

One procedure involving primary separation, disintegration, and final separation is recommended because the percent yield of annealed iron powder is increased, the amount of residual heat resisting powder is reduced, and the annealed iron powder will be compacted into a compact which is improved in density and saturation magnetization. Now that carbon dioxide gas evolving from the alkaline earth metal carbonate powder facilitates the separation of soft magnetic iron particles from other particles as previously mentioned, the disintegration step is quite effective.

Hammer mills and pin mills of high speed rotation type are useful disintegrating means. Disintegration is preferably carried out in a non-oxidizing atmosphere because soft magnetic iron particles on the surface are otherwise oxidized due to the heat released during disintegration, deteriorating magnetic properties.

Owing to the combined use of heat resisting powder and alkaline earth metal carbonate powder, the amount of heat resisting powder left in the iron powder at the end of separation and removal can be as low as 1.2% by weight or less. Especially when intermediate disintegration is carried out, the amount of heat resisting powder left in the iron powder can be reduced to 0.1% by weight or less. Typically at least 0.01% by weight of heat resisting powder is left in the iron powder.

Prior to mixing with the binder, the annealed iron powder may be subject to oxidizing treatment. This oxidizing treatment forms an oxide coating as thin as several tens of nanometers near the surface of iron particles whereupon an improvement in insulation is expectable. The oxidizing treatment may be done by heating in an oxidizing atmosphere such as air at a temperature of 150° to 300° C. for 5 minutes to 2 hours. It is noted that where oxidizing treatment is done, a binder containing a dispersant should preferably be used in order to improve the wettability of the iron particle surface as previously mentioned.

The dust core-forming iron powder composition according to the invention is preferably prepared by kneading the annealed iron powder with a binder solution. The binder solution is prepared by dispersing or dissolving in an organic solvent a binder consisting of silica sol, a silicone resin, an organic titanium compound and optionally, a dispersant as previously defined. Preferably the solution has a binder concentration of about 5 to 20% by weight. If the binder concentration is too low, uniform mixing with iron powder would become difficult. If the binder concentration is too high, removal of the solvent after kneading would become difficult. The organic solvent used herein should preferably be compatible with binder components and includes, for example, alcohol, acetone, toluene, xylene, ethylene glycol, and ether alone or in admixture of two or more. The means for kneading iron powder with the binder solution is not critical although kneading means capable of applying some stress, for example, kneaders are appropriate. Universal mixers and agitators may also be used although there is a likelihood to increase eddy current losses. Attritors are undesirable since excess stresses are introduced to increase coercivity.

After iron powder is mixed with the binder, the composition is subject to partial curing treatment. Curing treatment is generally carried out by heating the composition at a temperature in the range of 50° to 250°C., preferably 180° to 220° C. If the treating temperature is too low, several problems would arise. The silicone resin does not attenuate adhesiveness, allowing iron powder to agglomerate. Subsequent compaction is then difficult and a compact has poor shape retention. Undercure of the silicone resin allows the insulating coating to be broken during compaction. Additionally, the solvent of the binder solution is insufficiently removed to increase a core loss and a variation thereof. If the treating temperature is too high, several problems would arise. The silicone resin attenuates adhesiveness to such an extent that the shape retention of a subsequently formed compact is not improved. Overcure of the silicone resin causes the insulating coating on iron particles to swell, resulting in a dust core having lower density, lower magnetic permeability and lower magnetic flux density. The treating time, that is, the time of passage through the above-defined temperature range or the time when the composition is maintained in the above-defined temperature range is preferably about ½ to 2 hours. A shorter treating time gives rise to problems as found at too low treating temperatures whereas a longer treating time gives rise to problems as found at too high treating temperatures. Since curing treatment is carried out at a relatively low temperature as defined above, an oxidizing atmosphere such as air may be used rather than a non-oxidizing atmosphere. Treatment in an oxidizing atmosphere improves insulation because iron particles are somewhat oxidized on their surface.

At the end of curing treatment, iron particles bear on their surface a binder layer which preferably has a thickness of 50 to 160 nm, more preferably 65 to 130 nm. A too thin binder layer provides insufficient insulation between iron particles whereas a too thick binder layer results in a dust core having a low magnetic flux density. The thickness of the binder layer referred to herein is not an actual measurement as by ESCA, but a value calculated from the Si content obtained by compositional analysis of the binder layer. That is, calculation is done based on the assumption that Si detected is entirely in the form of $SiO_2$ and this $SiO_2$ covers the surface of spherical iron particles having a particle size as previously defined. An actual measurement by ESCA is generally about 1/10 of the calculated thickness.

After the curing treatment, a lubricant is preferably added to the core-forming iron powder composition. The lubricant serves to enhance lubrication among iron particles during compaction and improve release of a compact from a mold. The lubricant may be selected from various lubricants commonly used in dust cores, including organic lubricants which are solid at room temperature, for example, higher fatty acids and salts thereof such as stearic acid, zinc stearate, and aluminum stearate and wax; and inorganic lubricants such as molybdenum disulfide. The amount of lubricant added varies with a particular type of lubricant. Preferably a normally solid organic lubricant is added to the iron powder in an amount of 0.1 to 1% by weight, and an inorganic lubricant is added to the iron powder in an amount of 0.1 to 0.5% by weight. A less amount of the lubricant would be ineffective whereas a larger amount of the lubricant would result in a core having lower magnetic permeability and strength. It is noted that the lubricant is generally mixed with the iron powder after the curing treatment although the lubricant may be added prior to the curing treatment if it is tolerant to the heat of curing treatment.

Next, the core-forming iron powder composition is compacted into a compact of desired core shape. The core shape to which the invention is applicable is not critical and includes toroidal, EE, EI, ER, EPC, drum, pot and cup shapes, for example. Since the dust core of the invention is prepared by compaction, it can take any complex shape. One exemplary core shape is shown in FIG. 1. The core shown in FIG. 1 is a stator core for use in a brushless motor for hard disc drives. The stator core is slotted to define radial posts 2 having a coil wound thereon wherein a magnetic flux leaking from magnetic poles 3 at the tip of the posts 2 is utilized. The stator core of this configuration has an increased copper loss through the winding as compared with a core used in a closed magnetic circuit such as a toroidal core. Nevertheless, the invention reduces the overall loss of the circuit since the dust core of the invention has a reduced core loss. The stator core of the illustrated configuration wherein the height dimension of the post 2 is smaller than the height dimension of the magnetic pole 3 enables utilization of more magnetic flux and miniaturization. The size of the stator core may be properly determined depending on a particular object to which it is applied. Typically, the stator core has an inner diameter of about 3 to 20 mm and about seven (7) to forty (40) slots with a radial length of about 5 to 15 mm.

Compacting conditions are not critical and may be properly determined depending on the type, shape and size of iron powder particles as well as the size and density of an end core. Typically, the maximum pressure is about 6 to 20 $t/cm^2$ and the holding time at the maximum pressure is about 0.1 second to 1 minute.

After the compaction, the compact is annealed for improving magnetic properties as a core. The annealing treatment serves to relieve stresses which have been introduced into iron particles during pulverization and compaction. Where iron particles have been mechanically flattened, stresses introduced thereby can also be relieved by the annealing treatment. The annealing treatment also causes the silicone resin to fully cure and the compact to increase its density for improving mechanical strength.

Conditions of the annealing treatment may be properly determined depending on the type of iron powder, compacting conditions, and flattening conditions. Typically the annealing temperature is about 550° to 650° C., preferably about 570° to 630° C. Lower annealing temperatures would invite insufficient restoration of coercivity, an increased hysteresis loss and hence, an increased overall loss. Higher annealing temperatures would cause the insulating coating to be thermally broken, resulting in insufficient insulation and increased eddy current losses. The annealing time, that is, the time of passage through the above-defined temperature range or the time when the compact is maintained in the above-defined temperature range is preferably about 10 minutes to about 1 hour. A shorter time achieves insufficient annealing effect whereas a longer time tends to break insulation.

For preventing the magnetic flux density from declining due to oxidation of iron particles, the annealing treatment is carried out in a non-oxidizing atmosphere.

The annealing treatment completes a dust core, which is covered with an insulating film for ensuring insulation to the windings if necessary, assembled with another core, and inserted into a casing.

The dust core thus obtained contains silicon (Si), titanium (Ti), and oxygen (O) in addition to iron. The Si content is preferably 0.03 to 0.1% by weight, more preferably 0.05 to 0.08% by weight of the core. Outside this range, a lower Si content would impart insufficient insulation among iron particles and provide a dust core with low mechanical strength. A higher Si content means a greater percentage of a non-magnetic component which reduces the density and magnetic flux density of a dust core. The dust core preferably has an oxygen content of 300 to 2,500 ppm. More particularly, when the annealed iron powder is subject to oxidation treatment prior to mixing with the binder, the oxygen content of the dust core is preferably 500 to 2,500 ppm, more preferably 900 to 2,100 ppm. When no such oxidation treatment is done and insulation among iron particles is improved by oxidation concomitant with the curing treatment, the oxygen content of the dust core is preferably 300 to 2,300 ppm, more preferably 300 to 1,900 ppm. A lower oxygen content provides insufficient insulation among iron particles whereas a higher oxygen content means a greater percentage of a non-magnetic component which reduces the density and magnetic flux density of a dust core. Titanium contained in the dust core originates from the organic titanium compound. The Ti content which depends on the amount of silicone resin added is generally about 15 to 210 ppm.

In the dust core, iron particles have the same particle size distribution as in the starting iron powder.

EXAMPLE

Examples of the present invention are given below by way of illustration and not by way of limitation.

Example 1

Commercially available electrolytic iron powder which had been pre-annealed at 900° C. in hydrogen was classified to collect a fraction having a particle size in the range shown in Table 1, typically a fraction having a particle size of 125 to 180 μm. This starting iron powder was mixed with aluminum oxide powder having a mean particle size of 14 μm and calcium carbonate powder having a mean particle size of 5 μm and the ingredients were uniformly agitated. The apparent volume ratio of aluminum oxide powder to iron powder was 11/10. The amount of calcium carbonate powder added was 1% by weight of the iron powder. The powder mixture was placed in a sheath of aluminum oxide and then in a tunnel furnace where the mixture was heated in a 10/90 hydrogen/nitrogen mixed atmosphere. The furnace included a holding section having a temperature of 1,310° C. and a passage time of 3 hours. The powder mixture was cooled and then introduced into a vibrating sieve whereby the majority of aluminum oxide and calcium oxide, which was a decomposition product of the calcium carbonate, were separated and removed. Using a high speed rotation hammer mill, the mixture was disintegrated in a nitrogen atmosphere. The disintegrated mixture was introduced again into the vibrating sieve whereby sintered particles of a relatively large size and the residual aluminum oxide and calcium oxide were separated and removed, yielding an annealed iron powder. The amount of aluminum oxide left in the iron powder was measured by inductively coupled plasma (ICP) atomic emission spectrometry after dissolving iron particles with acid, finding a residual aluminum oxide content of 0.025% by weight. The annealed iron powder was recovered in a yield of 90%. Note that yield= (weight of recovered iron powder)/(weight of starting iron powder)×100%.

The annealed iron powder was subject to oxidation treatment. For oxidation treatment, the iron powder was heated in air in a rotary kiln at a selected temperature for a selected time. The oxygen content of iron powder was controlled by selecting the heating temperature in the range of 250° to 400° C. and the heating time in the range of 10 to 20 minutes.

After oxidation, the iron powder was kneaded with a binder solution for 30 minutes. For kneading purpose, a compact kneader was used. The binder solution contained silica sol (XBA-ST by Nissan Chemical K.K.), a solventless silicone resin (SR2414 by Toray-Dow K.K., a viscosity of 2,000 to 8,000 centipoise at 25° C.), an organic titanium compound of formula (I) wherein n=4 (TBT Polymer B-4 by Nisso K.K.), and ethyl cellulose as a dispersant in a solvent mixture of xylene and butanol. Table 1 shows the amount of silica sol added relative to the iron powder, the amount of silicone resin added relative to the iron powder, the amount of organic titanium compound added relative to the silicone resin, and the amount of dispersant added relative to the silicone resin and organic titanium compound. It is noted that the silica sol had a solid content of 30% by weight and the amount of silica sol reported in Table 1 was calculated as solids.

The iron powder kneaded with the binder solution was subject to curing treatment at the temperature shown in Table 1 for 30 minutes.

At the end of curing treatment, a lubricant was mixed with the iron powder by means of a V mixer. As the lubricant, zinc stearate was used in an amount of 0.2% by weight of the iron powder.

The iron powder was compacted into a compact of toroidal shape having an outer diameter of 17.5 mm, an inner diameter of 10.2 mm, and a height of 6 mm. The compacting pressure was 15 t/cm$^2$ and the time was 10 seconds.

Finally, the compact was annealed in a nitrogen atmosphere at the temperature shown in Table 1 for one hour, yielding a series of core samples.

Each core sample was measured for Si, Ti and oxygen contents as shown in Table 1. The Si and Ti contents were measured by ICP spectrometry. The oxygen content was measured by an oxygen analyzer using inert gas fusion infrared absorption (manufactured by Horiba Mfg. K.K.).

Each core sample was determined for magnetic flux density (B(100)) and coercivity (Hc) in an applied magnetic field of 100 Oe and hysteresis loss (Ph), eddy current loss (Pe) and core loss (Pc) at 100 mT.

Similarly, core samples of toroidal shape having an outer diameter of 14.9 mm, an inner diameter of 13.2 mm, and a height of 6 mm were prepared and measured for strength. For strength measurement, the core samples were subject to a rupture test using a desktop digital load tester (manufactured by Aoki Engineering K.K.). The samples were rated "O" when the strength is more than 30 MPa and "X" when the strength is less than 20 MPa.

The results are shown in Table 2.

TABLE 1

(oxidation treatment done)

| Sample No. | Silica sol solids (wt %) | Silicone resin (wt %) | Organo-titanium (wt %) | Dispersant (wt %) | Iron powder particle size (μm) | Curing temp. (°C.) | Annealing temp. (°C.) | Si content (wt %) | Oxygen content (ppm) | Ti content (ppm) |
|---|---|---|---|---|---|---|---|---|---|---|
| 1 | 0.063 | 0.10 | 20 | 8.3 | 180–125 | 200 | 600 | 0.042 | 950 | 94 |
| 2 | 0.096 | 0.05 | 20 | 8.3 | 180–125 | 200 | 600 | 0.051 | 1920 | 45 |
| 3 | 0.063 | 0.10 | 20 | 8.3 | 180–106 | 200 | 600 | 0.053 | 2090 | 96 |
| 4 (comparison) | 0.129 | —* | —* | — | 180–125 | 200 | 600 | 0.051 | 1880 | 4 |
| 5 (comparison) | 0.012* | 0.02* | 20 | 8.3 | 180–125 | 200 | 600 | 0.010* | 1440 | 19 |
| 6 (comparison) | 0.063 | 0.60* | 20 | 1.4 | 180–125 | 200 | 600 | 0.231 | 3940 | 560 |
| 7 (comparison) | —* | 0.20 | 20 | 4.2 | 180–125 | 200 | 600 | 0.060 | 2020 | 120 |
| 8 (comparison) | 0.225* | 0.30 | 23 | 8.1 | 180–125 | 200 | 600 | 0.150* | 3740* | 285 |
| 9 (comparison) | 0.063 | 0.10 | —* | 8.3 | 180–125 | 200 | 600 | 0.048 | 1890 | 3 |
| 10 (comparison) | 0.063 | 0.10 | 200* | 3.3 | 180–125 | 200 | 600 | 0.052 | 1930 | 900 |
| 11 (comparison) | 0.063 | 0.10 | 20 | 50* | 180–125 | 200 | 600 | 0.043 | 1830 | 90 |
| 12 (comparison) | 0.063 | 0.10 | 20 | 8.3 | 150–45* | 200 | 600 | 0.051 | 2380 | 95 |
| 13 (comparison) | 0.063 | 0.10 | 20 | 8.3 | 210–350* | 200 | 600 | 0.048 | 1380 | 94 |
| 14 (comparison) | 0.063 | 0.10 | 20 | 8.3 | 180–125 | 200 | 600 | 0.050 | 300* | 90 |
| 15 (comparison) | 0.063 | 0.10 | 20 | 8.3 | 180–125 | 200 | 600 | 0.050 | 2890* | 96 |
| 16 (comparison) | 0.063 | 0.10 | 20 | 8.3 | 180–125 | 600* | 600 | 0.042 | 900 | 94 |
| 17 (comparison) | 0.063 | 0.10 | 20 | 8.3 | 180–125 | 200 | 500* | 0.042 | 1010 | 95 |
| 18 (comparison) | 0.063 | 0.10 | 20 | 8.3 | 180–125 | 200 | 700* | 0.042 | 900 | 93 |
| 19 (comparison) | Silicone steel (gage 0.35 mm) | | | | | | | | | |

*outside the scope of the invention

TABLE 2

(oxidation treatment done)

| Sample No. | B(100) (kG) | Hc (Oe) | Loss (kW/m³) (450 Hz/1000 Hz) Pc | Ph | Pe | Strength (MPa) |
|---|---|---|---|---|---|---|
| 1 | 15.6 | 1.67 | 258/650 | 219/487 | 34/166 | ○ |
| 2 | 15.7 | 1.67 | 262/650 | 224/498 | 29/142 | ○ |
| 3 | 15.8 | 1.67 | 269/674 | 227/504 | 36/176 | ○ |
| 4 | 15.8 | 1.50 | 232/609 | 193/429 | 37/184 | X** |

TABLE 2-continued (oxidation treatment done)

| Sample No. | B(100) (kG) | Hc (Oe) | Loss (kW/m³) (450 Hz/1000 Hz) Pc | Ph | Pe | Strength (MPa) |
|---|---|---|---|---|---|---|
| (comparison) 5 (comparison) | 16.4 | 1.67 | 283/805** | 220/495 | 63/310 | X** |

TABLE 2-continued (oxidation treatment done)

| Sample No. | B(100) (kG) | Hc (Oe) | Loss (kW/m³) (450 Hz/1000 Hz) Pc | Ph | Pe | Strength (MPa) |
|---|---|---|---|---|---|---|
| 6 (comparison) | 13.4** | 1.67 | 246/620 | 230/510 | 21/105 | ○ |
| 7 | 16.0 | 1.58 | 316/973** | 210/468 | 103/510 | ○ |

TABLE 2-continued (oxidation treatment done)

| Sample No. | B(100) (kG) | Hc (Oe) | Loss (kW/m³) (450 Hz/1000 Hz) Pc | Ph | Pe | Strength (MPa) |
|---|---|---|---|---|---|---|
| (comparison) 8 | 14.3** | 1.67 | 229/569 | 210/465 | 19/94 | ○ |
| (comparison) 9 | 15.5 | 1.58 | 275/740** | 220/490 | 50/247 | X** |
| (comparison) 10 | 15.0 | 1.80** | 301/860** | 230/510 | 71/350 | ○ |
| (comparison) 11 | 15.5 | 1.58 | 310/920** | 220/490 | 87/430 | X** |
| (comparison) 12 | 15.4 | 1.80** | 313/890** | 240/530 | 73/360 | ○ |
| (comparison) 13 | 15.9 | 1.33 | 308/944** | 193/430 | 108/533 | ○ |
| (comparison) 14 | 16.5 | 1.67 | 301/861** | 230/511 | 71/350 | ○ |
| (comparison) 15 | 14.7 | 1.67 | 246/580 | 216/480 | 20/100 | ○ |
| (comparison) 16 | 15.3** | 1.58 | 252/613 | 216/479 | 28/139 | X** |
| (comparison) 17 | 15.7 | 1.82** | 283/707** | 255/567 | 28/140 | ○ |
| (comparison) 18 | 15.8 | 1.58 | 392/1269** | 226/502 | 157/773 | ○ |
| (comparison) 19 | 17.0 | 0.73 | 270/942** | 130/270 | 137/978 | ○ |
| (comparison) | | | | | | |

**unacceptable properties

As is evident from Table 2, the objects are achieved by the invention. Sample Nos. 1 to 3 wherein iron powder is mixed with a binder within the range of the invention and subject to curing and annealing treatments had Si, Ti and oxygen contents within the range of the invention, improved soft magnetic properties, low losses, and high mechanical strength. The samples within the scope of the invention have extremely low losses as compared with sample No. 20 using silicon steel, indicating satisfactory performance as a substitute for the silicon steel lamination core.

In contrast, sample Nos. 4 to 13 wherein at least one of the silica sol amount, silicone resin amount, organic titanium compound amount, dispersant amount and iron powder particle size is outside the scope of the invention are unsatisfactory with respect to B(100), Hc, loss and/or strength. Sample No. 14 having a too low oxygen content shows an increased loss. Sample No. 15 having a too high oxygen content shows low B(100). Sample No. 16 wherein the temperature of curing treatment is too high has an unsatisfactory strength and somewhat low B(100). Sample No. 17 wherein the temperature of annealing treatment is too low has high Hc and an increased loss. Sample No. 18 wherein the temperature of annealing treatment is too high has an increased loss.

Example 2

The annealed iron powder obtained in Example 1 after the separation and removal step was not subject to oxidation treatment. A binder solution was prepared as in Example 1 except that the dispersant was omitted. The iron powder was kneaded with the binder solution. Table 3 shows the amount of silica sol added relative to the iron powder, the amount of silicone resin added relative to the iron powder, and the amount of organic titanium compound added relative to the silicone resin.

The iron powder kneaded with the binder solution was subject to curing treatment at the temperature shown in Table 3. The oxygen content of iron powder was controlled by varying the curing time in the range of 30 to 180 minutes.

After the curing treatment, the iron powder was compacted and annealed as in Example 1, obtaining a series of core samples. The temperature of annealing treatment is shown in Table 3.

Each core sample was examined as in Example 1. The results are shown in Tables 3 and 4.

TABLE 3

(oxidation treatment done)

| Sample No. | Silica sol solids (wt %) | Silicone resin (wt %) | Organo-titanium (wt %) | Dispersant (wt %) | Iron powder particle size (μm) | Curing temp. (°C.) | Annealing temp. (°C.) | Si content (wt %) | Oxygen content (ppm) | Ti content (ppm) |
|---|---|---|---|---|---|---|---|---|---|---|
| 20 | 0.063 | 0.10 | 20 | — | 180–125 | 200 | 600 | 0.042 | 950 | 94 |
| 21 | 0.096 | 0.05 | 20 | — | 180–125 | 200 | 600 | 0.051 | 1720 | 45 |
| 22 | 0.063 | 0.10 | 20 | — | 180–106 | 200 | 600 | 0.053 | 1890 | 96 |

TABLE 4

(oxidation treatment done)

| Sample No. | B(100) (kG) | Hc (Oe) | Loss (kW/m³) (450 Hz/1000 Hz) Pc | Ph | Pe | Strength (MPa) |
|---|---|---|---|---|---|---|
| 20 | 15.6 | 1.67 | 258/661 | 225/500 | 33/161 | ○ |
| 21 | 15.7 | 1.67 | 258/648 | 230/511 | 28/137 | ○ |
| 22 | 15.8 | 1.67 | 268/668 | 233/517 | 35/171 | ○ |

As is evident from Tables 3 and 4, when the annealed iron powder is not subject to oxidation treatment, any loss increase can be suppressed by omitting the dispersant from the binder.

Figure 2:
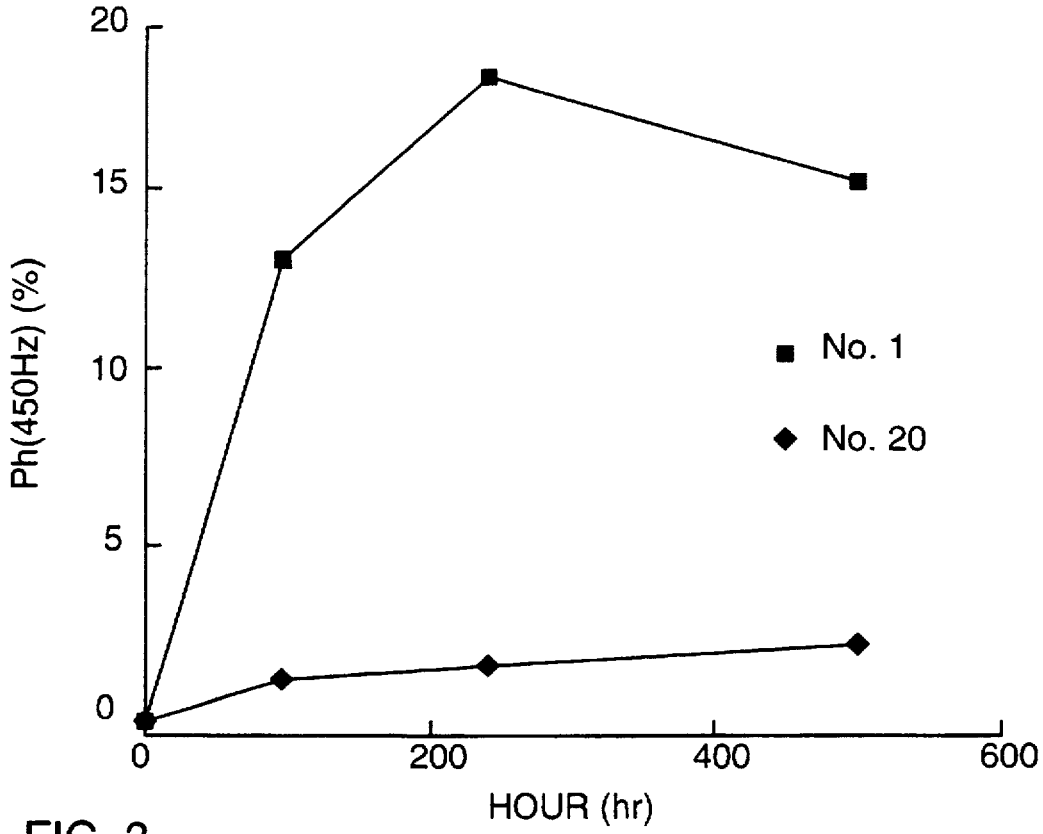
FIG. 2 is graph showing a change of the hysteresis loss (Ph) of dust cores with time when the cores are allowed to stand in a high temperature environment.
Figure 3:
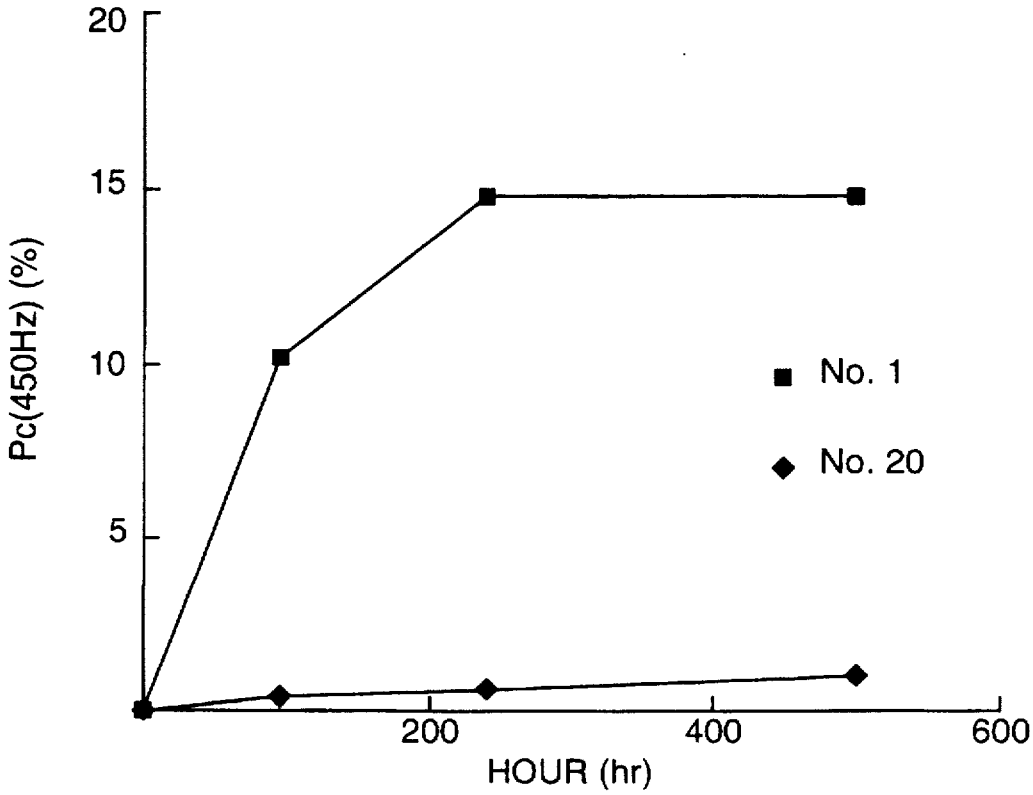
FIG. 3 is graph showing a change of the core loss (Pc) of dust cores with time when the cores are allowed to stand in a high temperature environment.

Sample No. 1 shown in Tables 1 and 2 and sample No. 20 shown in Tables 3 and 4 were subject to a hot aging test wherein the samples were allowed to stand in an environment at 125° C. while a hysteresis loss and a core loss at 450 Hz were measured at intervals. The hysteresis loss (Ph) is plotted relative to the lapse of time in the graph of FIG. 2. The core loss (Pc) is plotted relative to the lapse of time in the graph of FIG. 3. It is evident that the cores become more reliable where the dispersant is omitted from the binder.

There has been demonstrated the effectiveness of the invention.

While the invention has been described in what is presently considered to be a preferred embodiment, other variations and modifications will become apparent to those skilled in the art. It is intended, therefore, that the invention not be limited to the illustrative embodiments, but be interpreted within the full spirit and scope of the appended claims.

We claim:

1. A dust core consisting essentially of iron powder particles with a particle size of 75 to 200 μm, 0.03 to 0.1% by weight of silicon, 15 to 210 ppm of titanium, and 300 to 2,500 ppm of oxygen.

2. A dust core, prepared by a process comprising the steps of:

furnishing a core-forming iron powder composition comprising iron powder consisting of particles with a particle size of 75 to 200 μm, 0.015 to 0.15% by weight as solids based on the iron powder of silica sol, 0.05 to 0.5% by weight based on the iron powder of a silicone resin, and 10 to 50% by weight based on the silicone resin of an organic titanium compound, subjecting the iron powder composition to a curing treatment at 50° to 250° C., compacting the cured iron powder composition into a compact, and annealing the compact in an inert atmosphere at 550°to 650° C.

3. The dust core of claim 2 wherein said dust core consists essentially of iron powder particles with a particle size of 75 to 200 μm, 0.03 to 0.1% by weight of silicon, 15 to 210 ppm of titanium, and 300 to 2,500 ppm of oxygen.

4. The dust core of claim 2 wherein the step of furnishing a core-forming iron powder composition includes the steps of:

subjecting a powder mixture of a starting iron powder, a heat resisting powder, and 0.5 to 5% by weight of the starting iron powder of an alkaline earth metal carbonate powder to heat treatment for annealing, whereby the alkaline earth metal carbonate is decomposed into an alkaline earth metal oxide, separating the heat resisting powder and the alkaline earth metal oxide powder from the powder mixture to leave an annealed iron powder, and adding silica sol, a silicone resin and an organic titanium compound to the annealed iron powder.

5. The dust core of claim 4 wherein the step of furnishing a core-forming iron powder composition further includes the step of:

adding a dispersant to the annealed iron powder.

6. The dust core of claim 4 wherein the step of furnishing a core-forming iron powder composition further includes the step of:

subjecting the annealed iron powder to oxidation treatment prior to the addition step.

7. The dust core of claim 4 wherein the heat treatment of a powder mixture for annealing is carried out in a hydrogen/nitrogen mixed atmosphere or a pure nitrogen atmosphere.

8. The dust core of claim 4 wherein the heat treatment of a powder mixture for annealing is carried out at a temperature of 1,200° to 1,400° C.

9. The dust core of claim 4 wherein the step of furnishing a core-forming iron powder composition further includes the step of:

disintegrating the heat treated powder mixture in a non-oxidizing atmosphere, prior to the step of separating the heat resisting powder and the alkaline earth metal oxide powder from the powder mixture.

* * * * *

UNITED STATES PATENT AND TRADEMARK OFFICE

CERTIFICATE OF CORRECTION

PATENT NO. : 5,800,636
DATED : Sep. 1, 1998
INVENTOR(S) : Tsukada et al.

It is certified that error appears in the above-identified patent and that said Letters Patent is hereby corrected as shown below:

col. 13, line 4, delete " 100 mT " and insert -- 1,000 mT --.

Signed and Sealed this

Ninth Day of March, 1999

*Attest:*

*Attesting Officer*

Q. TODD DICKINSON

*Acting Commissioner of Patents and Trademarks*